US011268302B2

(12) United States Patent
Mathas

(10) Patent No.: US 11,268,302 B2
(45) Date of Patent: Mar. 8, 2022

(54) LOCKING DEVICE

(71) Applicant: Christoph Mathas, Munich (DE)

(72) Inventor: Christoph Mathas, Munich (DE)

( * ) Notice: Subject to any disclaimer, the term of this patent is extended or adjusted under 35 U.S.C. 154(b) by 370 days.

(21) Appl. No.: 16/379,055

(22) Filed: Apr. 9, 2019

(65) Prior Publication Data

US 2020/0325705 A1 Oct. 15, 2020

(51) Int. Cl.

| | |
|---|---|
| ***E05B 65/52*** | (2006.01) |
| ***A44B 11/25*** | (2006.01) |
| ***B65D 33/16*** | (2006.01) |
| ***E05B 73/00*** | (2006.01) |
| ***A44B 11/26*** | (2006.01) |

(52) U.S. Cl.

CPC ..... *E05B 65/5269* (2013.01); *A44B 11/2546* (2013.01); *A44B 11/2592* (2013.01); *A44B 11/26* (2013.01); *B65D 33/16* (2013.01); *E05B 73/0005* (2013.01)

(58) Field of Classification Search

CPC .. E05B 65/52; E05B 65/5246; E05B 65/5269; E05B 65/5284; E05B 73/00; E05B 73/0005; A44B 11/25; A44B 11/2542; A44B 11/2546; A44B 11/259226; B65D 33/16

See application file for complete search history.

(56) References Cited

U.S. PATENT DOCUMENTS 4,912,950 A * 4/1990 Crowle ..... E05B 65/5284 24/167
4,930,324 A * 6/1990 Meier ..... A44B 11/263 70/18
5,117,663 A * 6/1992 Ida ..... A44B 11/263 292/254

(Continued)

FOREIGN PATENT DOCUMENTS

DE 3817494 A1 11/1989
DE 102017009817 A1 4/2019

(Continued)

OTHER PUBLICATIONS

European Search Report issued in corresponding European Application No. 18000896, with English translation of category of cited documents, dated May 21, 2019 (6 pages).

*Primary Examiner* — Christopher J Boswell
(74) *Attorney, Agent, or Firm* — Flynn Thiel, P.C.

(57) ABSTRACT

Locking device having first and second combined connection carriers for establishing a detachable connection. A rotation element is rotatably attached at the first connection carrier and is provided in an inner region thereof. The inner region is centered with respect to a center axis and has a full radius. Elastic blocking heads are attached at the first connection carrier at the inner region, and are movable from a blocking to a release position. The rotation element includes segments extending up to the full radius and segments extending at a maximum up to a smaller inner (Continued)

radius. The segments extending up to the full radius move blocking heads into the release position and the segments extending up to the inner radius leave blocking heads in the blocking position. Key tongues move bordering ones of the blocking heads into the release position and allow rotation of the rotation element.

17 Claims, 7 Drawing Sheets

(56) References Cited

U.S. PATENT DOCUMENTS

| | | | | |
|---|---|---|---|---|
| 5,144,725 | A * | 9/1992 | Krauss | A44B 11/266 24/616 |
| 5,548,879 | A * | 8/1996 | Wu | A44B 11/263 24/616 |
| 6,871,517 | B2 * | 3/2005 | Bonelli | A44B 11/266 24/166 |
| 7,181,936 | B2 * | 2/2007 | Christensen | E05B 65/5284 70/389 |
| 10,226,106 | B2 * | 3/2019 | Postolek | A44B 11/266 |
| 2007/0266746 | A1 * | 11/2007 | Yu | E05B 35/08 70/69 |
| 2014/0317893 | A1 | 10/2014 | Takahashi | |
| 2015/0173491 | A1 | 6/2015 | Lesch | |

FOREIGN PATENT DOCUMENTS

| | | | |
|---|---|---|---|
| EP | 0363121 | A2 | 4/1990 |
| EP | 3382664 | A1 | 10/2018 |

* cited by examiner

LOCKING DEVICE

FIELD OF INVENTION

The invention pertains to a locking device. In particular, the invention can pertain to a locking device embodied as a push buckle lock, for example for use in a backpack or in bags.

BACKGROUND OF THE INVENTION

Flat connection carriers, which are characterized in that combining and locking complementary parts creates a permanent, but releasable connection between the complementary parts are widely used, for example as push buckle locks on a backpack. It is customary to connect such connection carriers to the item to be secured with flexible holding connectors made of flexible synthetic fabric.

DE 38 17 494 A1 describes a locking device having a locking cylinder and a flat key, the locking function of which is achieved by holding pins laterally disposed in a frame, which can depending on their position lock or release a rotation body.

SUMMARY OF THE INVENTION

According to an embodiment, a locking device with a first connection carrier and a second connection carrier, which are configured to be combined for establishing a detachable connection, is provided. A rotation element can be attached at the first connection carrier so as to be rotatable about a center axis, wherein the rotation element can be provided in a circular inner region of the first connection carrier, the circular inner region being centered with respect to the center axis and having a radius being designated as a full radius. A plurality of elastic blocking heads can be attached at the first connection carrier along a circumference of the inner region, wherein the blocking heads can be movable from a blocking position to a release position by mechanical pressure, wherein a blocking head protrudes into the inner region substantially up to a circular line centered with respect to the center axis and having a radius designated as an inner radius, which is smaller than the full radius, when in the blocking position, and does not protrude into the inner region when in the release position. The rotation element can comprise along its circumference segments which extend outwardly up to the full radius and segments which extend outwardly at a maximum up to the inner radius, wherein the segments extending outwardly up to the full radius can move blocking heads bordering from outwards into the release position and segments extending outwardly at a maximum up to the inner radius can leave blocking heads bordering from outwards in the blocking position, such that rotation of the rotation element is blocked by engagement of the blocking heads that are in the blocking position with a circumference of the rotation element. The locking device can comprise a flat key element having key tongues that are configured to be inserted into corresponding recesses in a surface of the rotation element, wherein the recesses can be formed in those segments of the rotation element that extend outwardly at a maximum up to the inner radius, and wherein the key tongues can be, in the inserted state, configured to move the blocking heads bordering from outwards at the segments of the key element receiving the key tongues into the release position and to thereby allow rotation of the rotation element.

According to another embodiment, a locking device with a first connection carrier and a second connection carrier, which are configured to be combined for establishing a detachable connection, is provided. A rotation element can be attached at the first connection carrier so as to be rotatable about a center axis. A locking bar can be connected to the center axis, wherein the locking bar can be rotatable by rotation of the rotation element between a locked position, in which the first connection carrier is inseparable from the second connection carrier, and an unlocked position, in which the first connection carrier and the second connection carrier are releasable from each other. The rotation element can be provided in a circular inner region of the first connection carrier, the circular inner region being centered with respect to the center axis and having a radius being designated as a full radius. A plurality of elastic blocking heads can be attached at the first connection carrier along a circumference of the inner region, wherein the blocking heads can be movable from a blocking position to a release position by mechanical pressure, wherein a blocking head does not protrude into the inner region when in the release position, and protrudes into the inner region when in the blocking position. The rotation element may comprise along its circumference segments which extend outwardly up to the full radius and segments which extend outwardly less than up to the full radius, wherein the segments extending outwardly up to the full radius can move blocking heads bordering from outwards into the release position and segments extending outwardly less than up to the full radius can leave blocking heads bordering from outwards in the blocking position, such that rotation of the rotation element is blocked by engagement of the blocking heads that are in the blocking position with a circumference of the rotation element. The locking device may comprise a flat key element having key tongues that can be configured to be inserted into corresponding recesses in a surface of the rotation element, wherein the recesses can be formed in those segments of the rotation element that extend outwardly less than up to the full radius, and wherein the key tongues can be, in the inserted state, configured to move the blocking heads bordering from outwards at the segments of the key element receiving the key tongues into the release position and to thereby allow rotation of the rotation element.

According to a further embodiment, a locking device with a lock carrying connection carrier and a latching connection carrier, which are configured to be combined for establishing a detachable connection, is provided. A rotation element can be attached at the lock carrying connection carrier so as to be rotatable about a center axis. A locking bar can be connected to the center axis, wherein the locking bar can be rotatable by rotation of the rotation element between a locked position, in which the locking bar lockingly engages a holding tongue of the latching connection carrier, and an unlocked position, in which the locking bar does not engage the locking tongue of the latching connection carrier. The rotation element can be provided in a circular inner region of the lock carrying connection carrier, the circular inner region being centered with respect to the center axis and having a radius being designated as a full radius. A plurality of elastic blocking heads can be attached at the lock carrying connection carrier along a circumference of the inner region, wherein the blocking heads can be movable from a blocking position to a release position by mechanical pressure, wherein a blocking head protrudes into the inner region substantially up to a circular line centered with respect to the center axis and having a radius designated as an inner radius, which is smaller than the full radius, when in the blocking position, and does not protrude into the inner region when in the release position. The rotation element can comprise along its circumference segments which extend outwardly up to the full radius and segments which extend outwardly at a maximum up to the inner radius, wherein the segments extending outwardly up to the full radius can move blocking heads bordering from outwards into the release position and segments extending outwardly at a maximum up to the inner radius can leave blocking heads bordering from outwards in the blocking position, such that rotation of the rotation element is blocked by engagement of the blocking heads that are in the blocking position with a circumference of the rotation element. The locking device can comprise a flat key element having key tongues that may be configured to be inserted into corresponding recesses in a surface of the rotation element, wherein the recesses may be formed in those segments of the rotation element that extend outwardly at a maximum up to the inner radius, and wherein the key tongues may be, in the inserted state, configured to move the blocking heads bordering from outwards at the segments of the key element receiving the key tongues into the release position and to thereby allow rotation of the rotation element.

The locking device according to the invention can comprise first and second connection carriers, which are configured to be combined for establishing a detachable connection. The connection carriers can, in principle, comprise arbitrary elements, which can be connected. According to a preferred embodiment, the first and second connection carriers are elements of a push buckle lock, which can be combined. However, the invention is not limited to this. For example, the connection carriers can also be other connectable elements or be connected to other connectable elements. For example, the invention could also be applied to a locking device for a briefcase, a suitcase, or even a locking device for a door, for example a door of a cabinet. Also, other ways of applying the invention are conceivable.

The locking device can due to its locking mechanism combine the versatile usability of connection carriers and the possibility of providing individualized security, so as to make it lockable and allow locking or opening only by persons, which have a suitable insertable key element. The key element can exactly fit into corresponding recesses upon insertion into the rotation element and can be removed and separated from the rotation element both in the opened and in the locked state of the locking device.

The locking device provides a possibility of securing mutually combined and locked connection carriers against unauthorized unlocking, when the owner of the respective item is not present, which is suitable for day to day use and can be used for transport security against light forms of theft, when travelling.

The locking device can be manufactured from commonly used materials (for example, plastic materials), can be adjusted in its complexity and does not require elaborate technical position engineering, such as a lock cylinder.

DETAILED DESCRIPTION

Figure 1A:
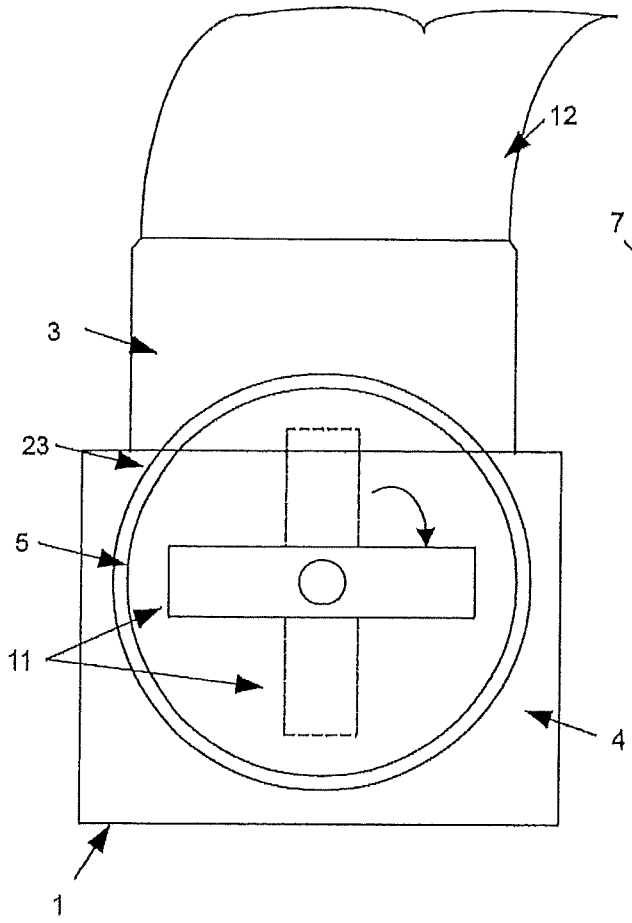
FIG. 1A shows a schematic view of the lock carrying connection carrier and FIG. 1B shows the latching connection carrier of a locking device according to an embodiment in a separated state.
Figure 1B:
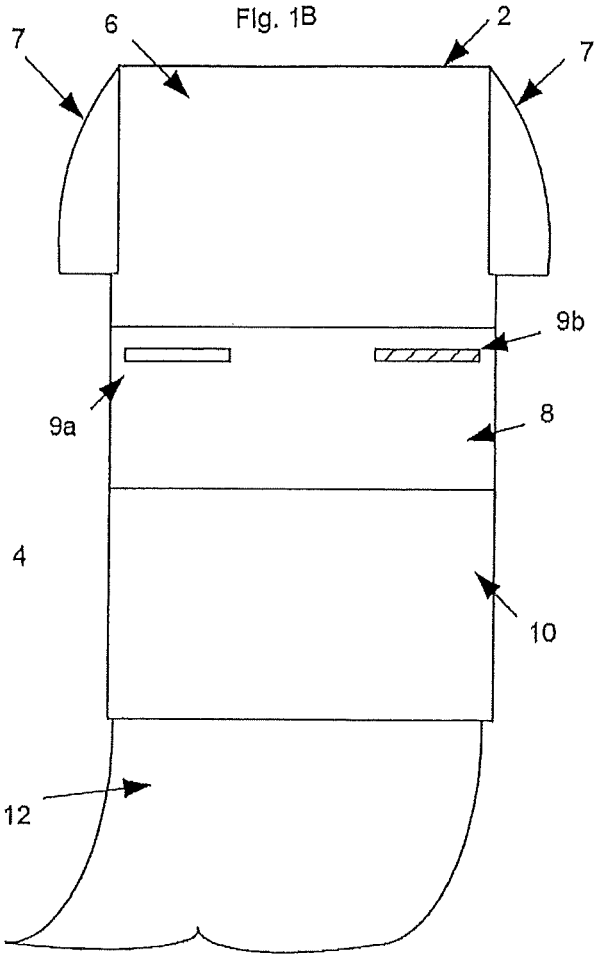
Figure 2:
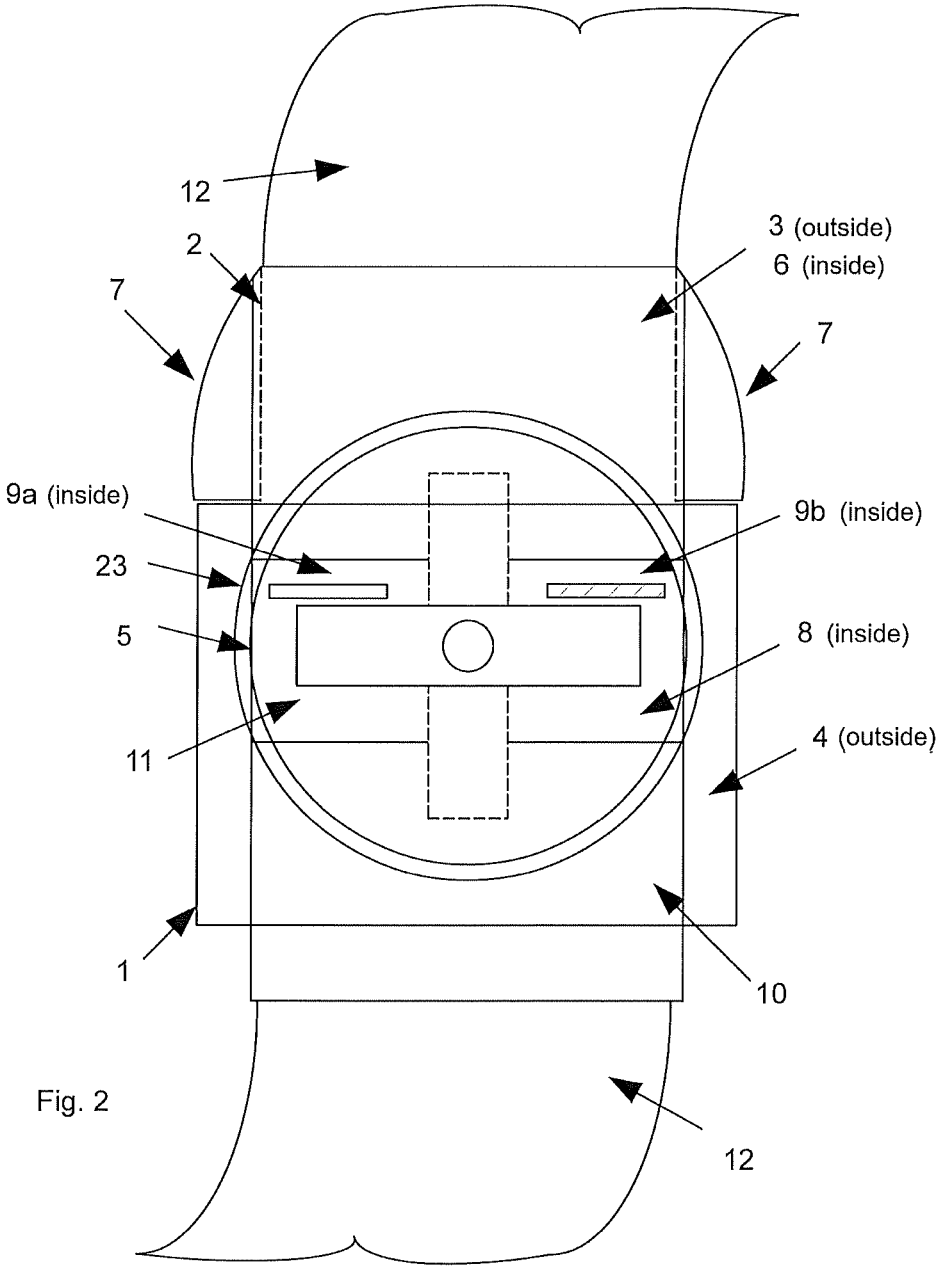
FIG. 2 shows a schematic view of the lock carrying connection carrier and the latching connection carrier of a locking device according to the embodiment in the connected state.

FIGS. 1A, 1B and 2 show a simplified overview over a locking device according to an embodiment. The locking device comprises a lock carrying connection carrier 1, which is at one side fixedly connected with a flexible holding carrier 12, and a latching connection carrier 2, which is at one side fixedly connected to another flexible holding carrier 12. The lock carrying connection carrier 1 and the latching connection carrier 2 can be combined as a pair for establishing a connection.

The lock carrying connection carrier 1 comprises a foot element 3, which is connected with the flexible holding carrier 12, and receives a head element 6 of the latching connection carrier 2 after the lock carrying connection carrier 1 and the latching connection carrier 2 are combined, stabilized by lateral latching bars 7 of the latching connection carrier 2, which have a non-secured press function. The latching connection carrier 2 is with a foot element 10, in analogy to the foot element 3 of the lock carrying connection carrier 1, at one side fixedly connected with its flexible holding connector 12.

The lock carrying connection carrier 1 comprises a head element 4 with a frame 23, which is at least partially integrated. The frame 23 surrounds a circular inner region 5, in which a rotation element 13 for locking or unlocking the locking device is provided.

The quadrants Q1-Q4 of a circular line limiting the inner region 5 of the frame 23 towards an outside are separated in the same manner each into at least one segment each or into an arbitrary number of segments S1-S12. For each segment of S1-S12, a blocking head 24*a*, 24*b* (see FIG. 5) is provided inside the frame 23, the blocking heads 24*a*, 24*b* being laterally movable by mechanical pressure out of the inner region 5 of the frame 23 into an outer region 23*c* inside the frame 23, in particular by bending or shifting. Without directed mechanical pressure, the blocking heads 24*a*, 24*b* spring back into the inner region 5 of the frame 23. As needed, the frame 23 can be partially or fully (in a preferred embodiment over a half circle of 180 degrees) be provided with an outer cover in order to prevent unauthorized access to the blocking heads 24*a*, 24*b* in an improved manner.

Figure 3:
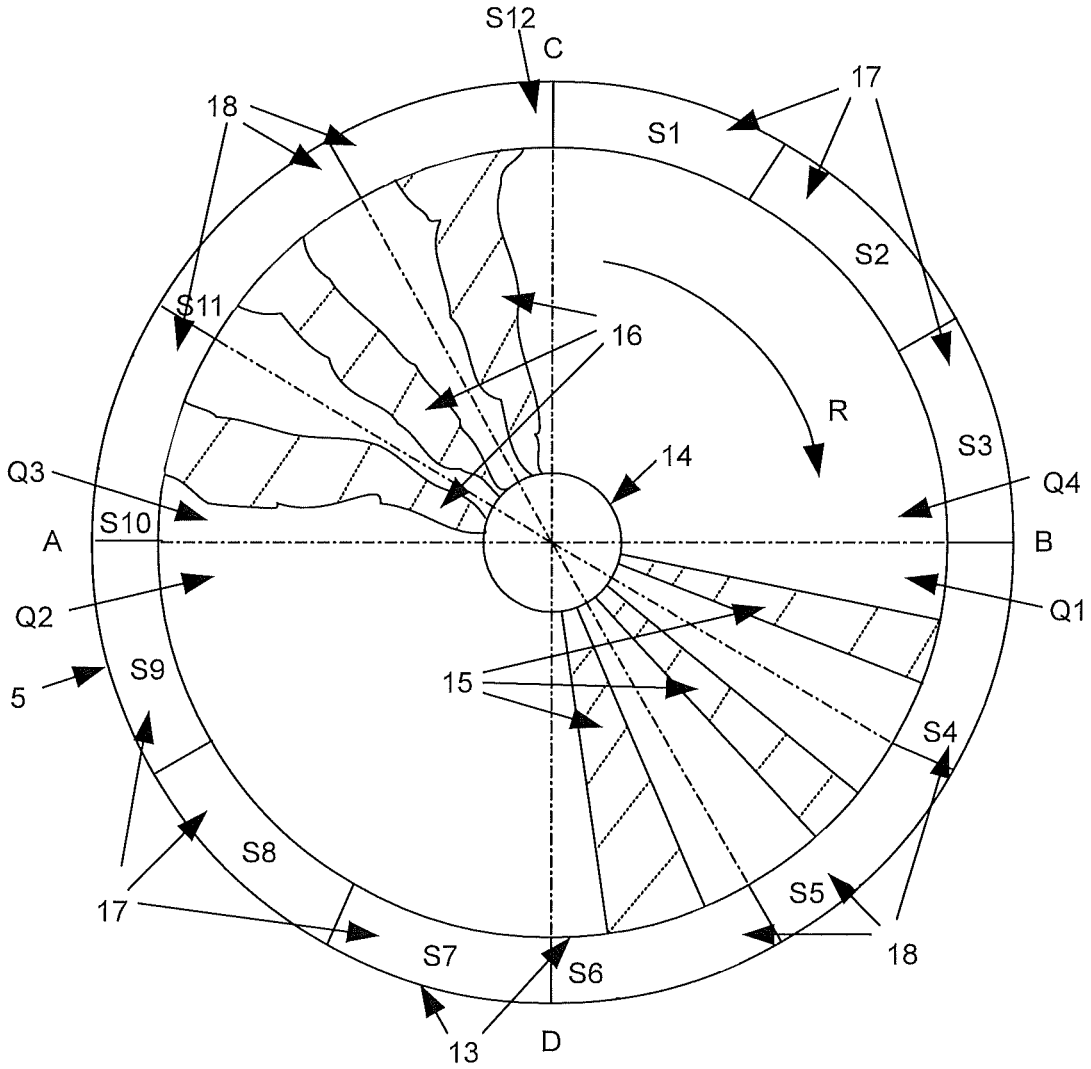
FIG. 3 shows a schematic top view onto the frame and the rotation element provided therein for a preferred embodiment of the locking device.
Figure 4:
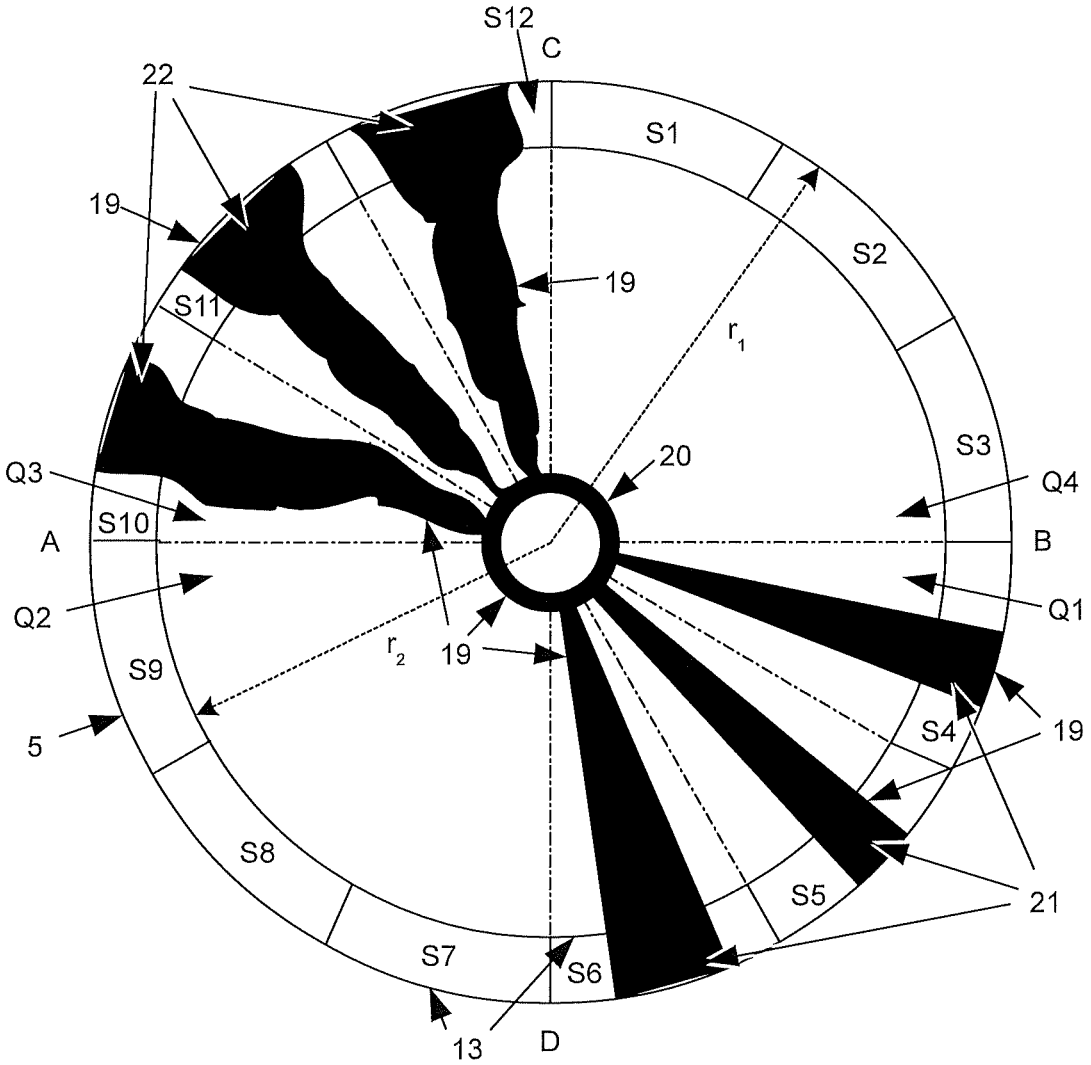
FIG. 4 shows a schematic top view onto the frame and the rotation element provided therein with inserted key element for executing the locking function for a preferred embodiment of the locking device in analogy to FIG. 3.

The rotation element 13, which is provided inside the circular inner region 5 of the frame 23, comprises a possibility for receiving a flat key element 19 via individually adjusted recesses 15, 16 in the surface of the key element 19 (see FIGS. 3 and 4). The rotation element 13 is, in connection with the inserted key element 19, rotatable about a specific rotation angle (a quarter circle of 90 degrees for a preferred embodiment) in both directions.

The flat key element 19 exactly inserts with its key tongues 21, 22 into the recesses 15, 16 in the rotation element 13 and can be inserted into the rotation element 13. By inserting the key element 19 into the rotation element 13, both elements are rotatable together. The key element 19 is, according to a preferred embodiment, insertable into the rotation element 13 or removable from the rotation element 13 both in the opened and in the closed state of the locking device according to the invention.

Below the rotation element 13, a locking bar 11 is attached to a center axis 25 of the rotation element 13, the locking bar 11 moving in front of holding tongues 9*a*, 9*b* of the latching connection carrier 2 between the mutually combined connection carriers 1, 2 in a lateral direction upon locking the locking device in connection with the rotation element 13 (see FIGS. 1 and 2).

The latching connection carrier 2 comprises a flat connection element 8 with a lower rail having the upright standing holding tongues 9*a*, 9*b*, the lower rail lying below the rotatable elements of the locking device (rotation element 13 with inserted key element 19, center axis 25 leading to the locking bar 11) after the latching connection carrier 2 and the locking carrying connection carrier 1 have been mutually combined. The upright holding tongues 9*a*, 9*b* are disposed on the lower rail of the flat connection carrier 8 of the latching connection carrier 2 such that the latching connection carrier 2 can be mutually combined with the lock carrying connection carrier 1 in the opened position of the locking bar 11, and the holding tongues 9*a*, 9*b* inhibit mutual disengagement of the combined connection carriers 1, 2 in the locked position of the rotation bar 11. The rotation bar 11 lies laterally in front of the holding tongues 9*a*, 9*b* in its locked position and prohibits mutual disengagement of the combined connection carriers 1, 2, and allows mutual disengagement of the combined connection carriers 1, 2 in its opened position.

Important elements of the connection carriers 1, 2 are preferably manufactured from materials that are as stable with respect to form and pressure as possible. Such materials provide for a stable lateral guidance of the mutually combined connection carriers 1, 2 and secure the locking device according to the invention from unauthorized access.

FIG. 3 shows in a schematic manner and in a top view the construction of the frame 23, which surrounds the circular inner region 5, as well as the construction of the rotation element 13 provided therein for a particularly preferred embodiment of the locking device according to the invention. For locking the locking device according to the invention, the rotation element 13 is rotated about a quarter of a circle (90 degrees) in clockwise direction (arrow R in FIG. 3).

The circular line limiting the inner region 5 of the frame 23 towards an outside direction is divided into quadrants Q1-Q4, which in turn are divided into segments S1-S12 (for example three segments per quadrant). In principle, an arbitrary number of segments S1-S12 is possible. The key element 19 comprises more key tongues 21, 22 if the number of segments is larger. Further, security of the locking device according to the invention, the segmentation of which is repeated in all quadrants in a rotational symmetrical manner, is improved, if the number of segments is large.

A full radius r1 (see FIG. 4) is defined as the distance between the circular line limiting the inner region 5 of the frame 23 towards an outside and the center point of the inner region 5. If the rotation element 13 fills the inner region of the frame 23 laterally up to the full radius r1 for a specific segment, the corresponding blocking head 24*a* is moved out of the inner region 5 of the frame 23 into the outer region 23*c* inside the frame 23, in particular the blocking head 24*a* is bent.

An inner radius r2 is defined as the distance between the center point of the inner region 5 and an imaginary circular line around that center point, for which the rotation element 13 does barely not reach the blocking heads 24*a*, 24*b*, if it fills the inner region 5 of the frame 23 exactly up to the border of said circular line.

The rotation element 13 comprises a key mount 14 as a central recess with a fixing bottom 14*a* for holding the key element 19 inserted into the rotation element 13. Specific recesses 15 in the rotation element 13 for the key tongues 21 of the key element 19 can comprise straight line contours for unlocking the rotation element 13 within corresponding segments S4-S6 of the circular line limiting the inner region 5 towards an outside by inserting the key element 19 into the rotation element 13. Specific recesses 16 in the rotation element 13 for the key tongues 22 of the key element 19 can comprise curved line contours for unlocking the rotation element 13 in the corresponding segments S10-S12 of the circular line limiting the inner region 5 towards an outside by inserting the key elements 19 into the rotation element 13.

The rotation element 13 fills the inner region 5 for the segments 17 of the quadrants Q2 and Q4 of the circular line limiting the inner region 5 of the frame 23 towards an outside laterally up to the full radius r1 with respect to the axis of rotation.

The rotation element 13 fills the inner region 5 for the segments 18 of quadrants Q1 and Q3 of the circular line limiting the inner region 5 of the frame 23 towards an outside laterally up to the inner radius r2 with respect to the axis of rotation. The blocking heads 24*b* within those segments 18 are shifted by the corresponding key tongues 21, 22 of the key element 19 inserted into the rotation element 13 out of the inner region 5 of the frame 23 into the outer region 23*c* within the frame 23.

If the rotation element 13 comprises recesses 15, 16 for the key tongues 21, 22 of the key element 19 for all segments of the quadrants Q1-Q4 of the circular line limiting the inner region 5 of the frame 23 towards an outside, or only for a selection of the segments, depends on the security requirements for the locking device according to the invention.

FIG. 4 shows the construction of the key element 19 for executing the locking function for a particularly preferred embodiment of the locking device according to the invention in analogy to FIG. 3, schematically shown in top view. The key element 19 is illustrated in black.

The key element 19 comprises a central element 20 having a central holding head 20*a* for manually rotating the rotation element 13 in connection with the inserted key element 19. Key tongues 21 having straight contours are provided for unlocking the rotation element 13 within the respective segments S4-S6 of the circular line limiting the inner region 5 of the frame 23 towards an outer side. Key tongues 22 having curved contours are provided for unlocking the rotation element 13 within the corresponding segments S10-S12 of the circular line limiting the inner region 5 of the frame 23 towards an outer side.

Figure 5:
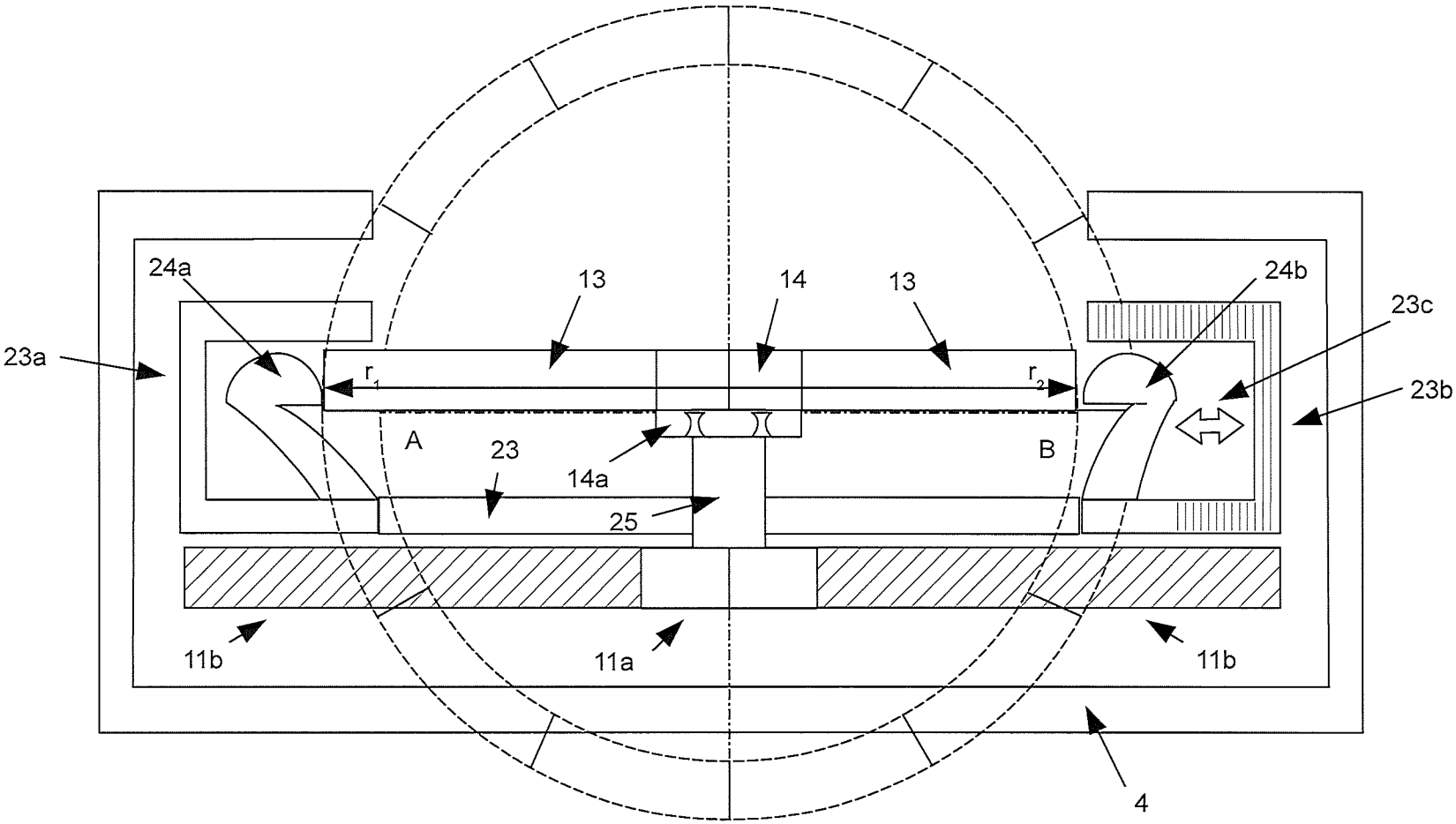
FIG. 5 shows a schematic cross section along the section line A-B of FIG. 4 with orientation in direction D.

FIG. 5 shows a schematic cross section along section line A-B of FIG. 4, with the orientation in the direction D, for a particularly preferred embodiment of the locking device according to the invention.

FIG. 5 in particular shows the frame 23 of the lock carrying connection carrier 1 with a lateral round guidance 23*a*, 23*b* surrounding the outer region 23*c* within frame 23.

As can be seen in FIG. 5, the rotation element 13 fills the inner region 5 of the frame 23 laterally up to the full radius r1 in direction A with respect to the axis of rotation for segment S9 of the circular line limiting the inner region 5 of the frame 23 towards an outside. It can be further be seen that the rotation element 13 fills the inner region 5 of the frame 24 laterally only up to the inner radius r2 in direction B with respect to the axis of rotation for segment S4 of the circular line limiting the inner region 5 of the frame 23 with respect to an outside. Within quadrant Q2, all blocking heads 24*a* have been shifted into the outer region 23*c* within the frame 23 by the rotation element 13. Therefore, the rotation element 13 is essentially unlocked in the region of quadrant Q2. According to FIG. 5, the locking function results from the blocking head 24*b* for segment S4 of quadrant Q1, which has been sprung back. Blocking head 24*b* locks the rotation element 13, if the key element 19 is not inserted in the region of quadrant Q4, in particular for segment S3.

The blocking head 24*a* is in an unlocked position and is bent out of the inner region 5 of the frame 23 into the outer region 23*c* within the frame 23. The blocking head 24*b* has been sprung back into the inner region 5 of the frame 23 and therefore is in a locking position.

The lateral round guidance 23*a*, 23*b* can be provided for protecting the blocking heads 24*a*, 24*b*. According to an embodiment, its outer cover extends over a half circle (180 degrees) of the frame 23, for example in the region of quadrants Q2 and Q3, with a round guidance 23*b* opened towards an upper side in the region of quadrants Q1 and Q4 in particular for segment S4 of FIG. 4 (hatched area). The key element 19 can be insertable into the rotation element 13 in a tilted orientation.

The center axis 25 of the rotation element 13, which leads to the rotation bar 11, ensures transmission of the rotating movement of the rotation element 13 in connection with the inserted key element 19 onto the rotation bar 11, such that the locking device according to the invention can manually be locked or unlocked.

In the unlocked position 11*a*, the rotation bar 11 is oriented in parallel to the sliding direction of the latching connection carrier 2 and the lock carrying connection carrier 1. In the locked state of the locking device according to the invention, the locking bar 11*b* lies perpendicular to the sliding direction of the latching connection carrier 2 and the lock carrying connection carrier 1 (hatched area).

Figure 6:
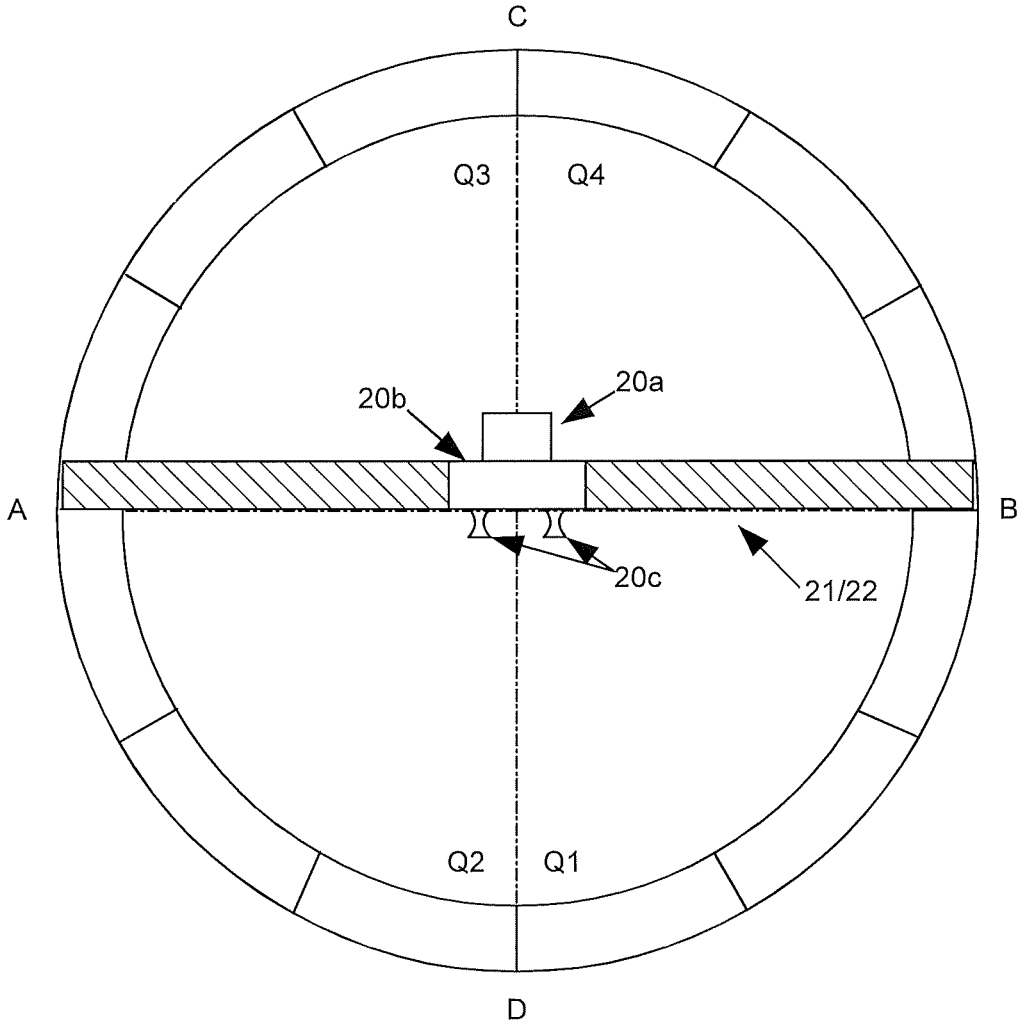
FIG. 6 shows a schematic cross section along the section line A-B of FIG. 4 through a key element inserted into the rotation element of the locking device.

FIG. 6 shows a schematic cross section along section line A-B of FIG. 4 through a key element 19 of the locking device according to the invention that is inserted into the rotation element 13.

The central element 20 of the key element 19 comprises a holding head 20*a* for manually rotating the rotation element 13 in connection with the inserted key element 19 and a basis element 20*b* at which the key tongues 21, 22 of the key element 19 come together and which is provided with holding tongues 20*c* towards its lower side, the holding tongues 20*c* holding the key element 19 inserted into the rotation element 13 at the fixing bottom 14*a* of the key mount 14.

Specifically along section line A-B of FIG. 4, no key tongue 21, 22 of the key element 19 is present. However, a possible position for a key tongue 21, 22 is indicated (hatched area).

According to a preferred embodiment, the locking function of the locking device according to the invention results at that side of the lower rail of the flat connection element 8 of the latching connection carrier 2, at which the continuous locking bar 11 rotates behind the locking tongue 9*a* of the latching locking carrier 2. On the opposite side, the locking bar 11 may pass the locking tongue 9*b* of the latching connection carrier 2, if necessary. The locking tongue 9*b* can therefore be provided with a lower height, and a respective profile recess can be provided in the surface of the rotation bar 11 to enable passing past the holding tongue 9*b* upon rotation of the rotation bar 11.

Figure 7:
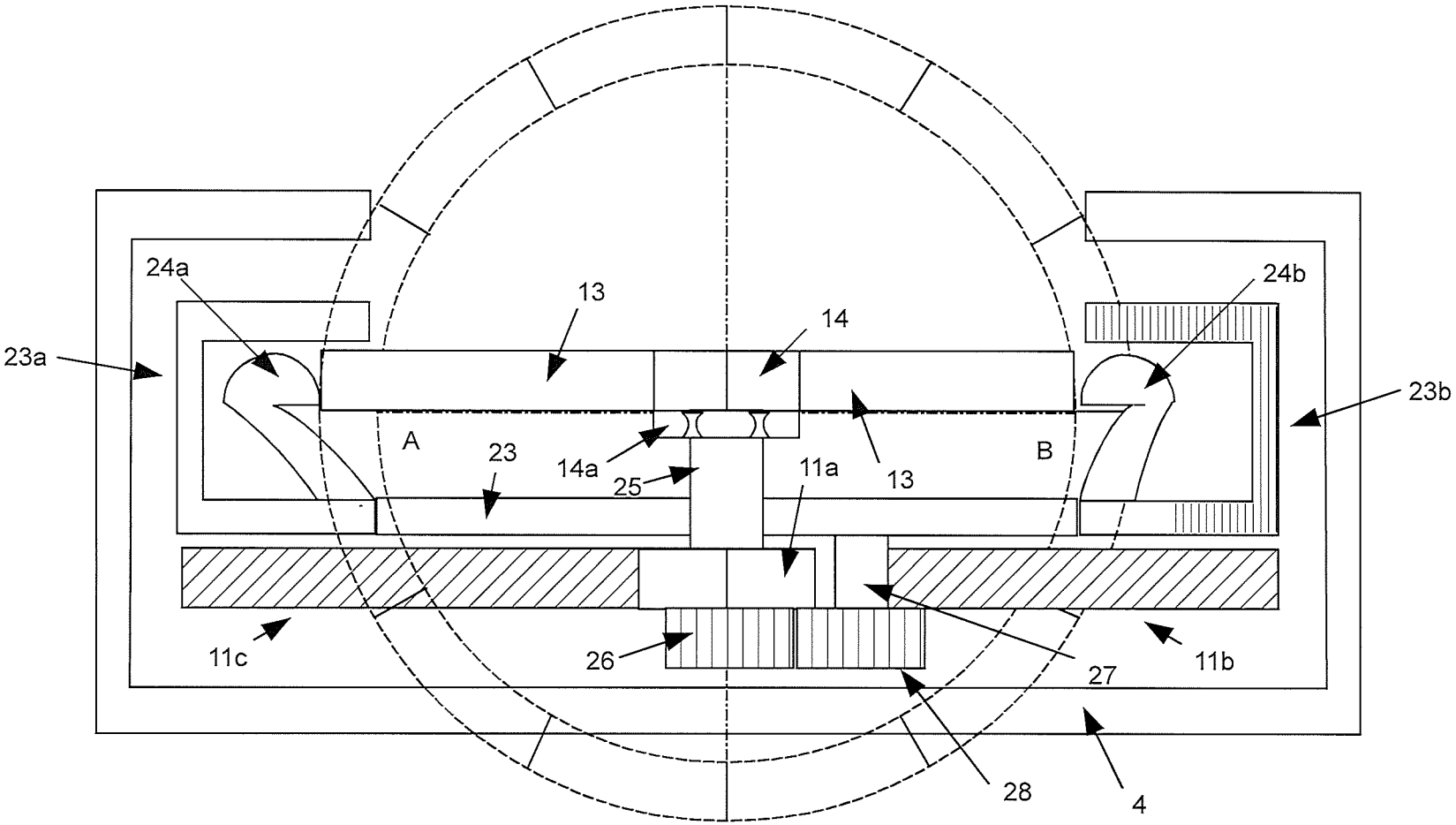
FIG. 7 shows a schematic cross section of the locking device in analogy to the illustration in FIG. 5 according to an alternative embodiment.

FIG. 7 shows another possibility for achieving a locking function over the complete width of the latching connection carrier 2. FIG. 7 shows a schematic cross section for a preferred embodiment of the locking device according to the invention in analogy to FIG. 5 along section line A-B, orientation in direction B, with consideration of rotation of two half bars 11*b*, 11*c* behind the locking tongues 9*a*, 9*b* of the latching connection carrier 2. In the following, only differences with respect to the embodiment shown in FIG. 5 are discussed.

Below the center axis 25 of the rotation element 13, a transmission gear wheel 26 is according to FIG. 7 provided for transmitting the rotation motion of the rotation element 13 in connection with the inserted key element 19 onto the half bar 11*b*. A center axis of the transmission gear wheel 27 is attached at a lateral bar of the frame 23. Due to transmission gear wheel 28, the half bar lib rotates in behind the holding tongue 9*b* of the latching connection carrier 2 in locking position. The half bars 11*b*, 11*c* are provided mutually offset and their lateral dimensions are selected such that they are parallel to each other in the sliding direction of the latching connection carrier 2 and the lock carrying connection carrier 1 in the opened state of the locking device according to the invention.

The locking device according to the invention can be manufactured from durable and form stable materials (for example plastic or metal), which also withstand larger tensile load or pressure load. This applies particularly to those elements on the side of the latching connection carrier 2, on which the rotation bar 11 rotates behind the holding tongue 9*a* and on which the main load rests in the locked state of the locking device.

The contours of the key tongues 21, 22 of the key element 19 can be kept as individual as possible by variation, in analogy to known cylinder keys.

For a preferred embodiment, the key element 19 can relate to at least corresponding segments 18 of two diagonally opposite quadrants Q1, Q3. Without the key element 19 being inserted into the rotation element 13, blocking heads 24*b*, which sprung back, lock the rotation element 19 within the segments 18 of those quadrants Q1, Q3.

The region of the blocking heads 24*a*, 24*b* can, in particular over a half circle of 180 degrees, be shielded by the lateral circular guidance 23*a*, 23*b* such that overcoming the locking function of the locking device according to the invention is made as difficult as possible, when using simple tools, in particular if the key element 19 has low complexity. Preferably, the key element 19 can be inserted into the rotation element 19, while being tilted.

Overcoming the locking function without a fitting key element 19 requires simultaneous access to the blocking heads 24*b* that lie diagonally opposing to each other within the frame 23.

The locking function between the combined connection carriers 1, 2 results from those holding tongues 9*a* of the flat connection element 8 of the latching connection carrier 2, behind which the rotation bar 11 rotates in. According to a preferred embodiment, the opposing holding tongue 9*b* is provided with a lower height so that the rotation bar 11 can rotate pass the locking tongue 9*b* due to corresponding profile recesses in its surface so that a locking function results on both sides of the locking bar 11.

For a preferred embodiment of the locking device according to the invention, locking, starting from an opened state, is achieved as follows:

1. If the locking device according to the invention is in the opened state, the rotation element 13 and the locking bar 11 connected to the rotation element 13 via the center axis 25 are oriented such that the locking bar 11 is parallel to the insertion direction of the latching connection carrier 2 and the lock carrying connection carrier 1.
2. The latch carrying connection carrier 2 is mutually combined with the lock carrying connection carrier 1. After combination, the lateral latching bar 7 having an unsecured press function holds the latching connection carrier 2 and the lock carrying connection carrier together as a push lock.
3. The key element 19 is inserted into the corresponding recesses in the rotation element 13 (key mount 14 and recesses 15, 16 for the key tongues 21, 22) and the rotation element 13 is rotated in combination with the inserted key element 19 by, in particular by a right angle (90 degrees) in a clockwise direction R. Thereby, the rotation bar 11 also rotates and comes to lie laterally behind the holding tongues 9*a*, 9*b* of the latching connection carrier 2 and creates the locking function of the locking device according to the invention.
4. In the closed state of the locking device according to the invention, the key element 19 is removable from the rotation element 13.
5. As a result, the combinable connection carriers 1, 2 are combined and locked such that mutual release via the lateral latching bars 7 is no longer possible.

For a preferred embodiment of the locking device according to the invention, opening, starting from a locked state, is carried out as follows:

1. If the locking device according to the invention having the mutually combined lock carrying connection carrier 1 and latching connection carrier 2 is in the locked state, the rotation element 13 and the rotation bar 11 connected to the rotation element 13 via the center axis 25 of the rotation element 13 are oriented such that the rotation bar 11 is oriented laterally to the insertion direction of the latching connection carrier 2 and the lock carrying connection carrier 1 and mutual release of the connection carriers 1, 2 is prohibited by the holding tongues 9*a*, 9*b* of the flat connection element 8 of the latching connection carrier 2.
2. The key element 19 is inserted into corresponding recesses in the rotation element 13 (key mount 14 and recesses 15, 16 for the key tongues 21, 22) and the rotation element 13 in connection with the inserted key element 19 is rotated about a right angle (90 degrees) against a clockwise direction. Thereby, the rotation bar 11 also rotates and orients itself in parallel to the insertion direction of the latching connection carrier 2 and the lock carrying connection carrier 2. The locking function of the locking device according to the invention is released.
3. The latching connection carrier 2 and the lock carrying connection carrier 1 can be released from each other via the lateral latching bars 7 of the latching connection carrier 2.
4. The inserted key element 19 can be removed from the rotation element 13. However, the key element 19 can also remain in its position until the locking device is again locked.

There are conceivable variations of the locking device according to the invention with increased complexity, for example by increasing the number of segments S1-S12 of the circular line limiting the inner region 5 of the frame 23 towards an outside and corresponding locking heads 24*a*, 24*b* provided within the frame 23.

According to an alternative, it would be conceivable that wires are guided within a hollow space in the key tongues 21, 22 of the key element 19 and that those wires can be laterally extended by actuation of a mechanical pressure button on the carrier head 20*a* of the key element 19, such that the key element 19 inserted in the rotation element 13 moves the blocking heads 24*b* within the corresponding segments 18 for which the rotation element 13 comprises recesses 15, 16 for the key tongues 21, 22 of the key element 19 into the outer region 23*c* within the frame even in the case where the key tongues 21, 22 themselves do not sufficiently fill the inner region 5 of the frame 23 up to the full radius r1 with respect to the rotation axis. For those segments 18, the rotation element 13 in connection with the inserted key element 19 is unlocked and rotatable. In particular, the frame 23 can be covered along its full circumference by a lateral circular guidance 23*a*, 23*b*, which shields the blocking heads 24*a* 24*b* provided within the frame 23 against access from outside, while the key element 19 is nevertheless insertable, so as to achieve improved security.

It would also be conceivable that the key tongues 21, 22 of the key element 19 interact with the blocking heads 24*a*, 24*b* within the frame 23 not by mechanical interaction but by electromagnetic interaction, for example by magnets provided behind the blocking heads 24*a*, 24*b* per blocking head, such that the blocking heads 24*a*, 24*b* are moved into the outer region 23*c* within the frame 23 without mechanical contact with the key tongues 21, 22 and without the key tongues 21, 22 of the key element 19 inserted into the rotation element 13 having to fill the inner region 5 of the frame 23 with respect to the rotation axis laterally up to the full radius r1 for the corresponding segments 18 having recesses, in order to unlock the rotation element 13 and in order to be able to rotate in combination with the inserted key elements 19. Also, the locking function of the locking device can be electrically controlled via a lateral bar or rotation bar 11, so that it is no longer necessary to mechanically transmit the rotation of the rotation element 13 via the center axis 25 of the rotation element 13.

The invention claimed is:

1. A locking device with a first connection carrier and a second connection carrier, which are configured to be combined for establishing a detachable connection, wherein a rotation element is attached at the first connection carrier so as to be rotatable about a center axis, wherein the rotation element is provided in a circular inner region of the first connection carrier, the circular inner region being centered with respect to the center axis and having a radius designated as a full radius;

a plurality of elastic blocking heads is attached at the first connection carrier along a circumference of the inner region, wherein the blocking heads are movable from a blocking position to a release position by mechanical pressure, wherein a blocking head protrudes into the inner region substantially up to a circular line centered with respect to the center axis and having a radius designated as an inner radius, which is smaller than the full radius, when in the blocking position, and does not protrude into the inner region when in the release position;

the rotation element comprises along its circumference segments which extend outwardly up to the full radius and segments which extend outwardly at a maximum up to the inner radius, wherein the segments extending outwardly up to the full radius move blocking heads bordering from outwards into the release position and segments extending outwardly at a maximum up to the inner radius leave blocking heads bordering from outwards in the blocking position, such that rotation of the rotation element is blocked by engagement of the blocking heads that are in the blocking position with a circumference of the rotation element; and the locking device comprises a flat key element having key tongues that are configured to be inserted into corresponding recesses in a surface of the rotation element, wherein the recesses are formed in those segments of the rotation element that extend outwardly at a maximum up to the inner radius, wherein the key tongues are, in the inserted state, configured to move the blocking heads bordering from outwards at the segments of the rotation element receiving the key tongues into the release position and to thereby allow rotation of the rotation element, and wherein opposing key tongues are symmetrically formed, so that the key element is insertable into the rotation element in two different orientations.

2. The locking device according to claim 1, wherein the first connection carrier is a lock carrying connection carrier and the second connection carrier is a latching connection carrier, wherein the lock carrying connection carrier and the latching connection carrier form a push buckle lock and are configured to be mutually combined.

3. The locking device according to claim 1, wherein the key tongues extend outwardly up to the full radius in the inserted state.

4. The locking device according to claim 1, wherein the key element fixedly snaps into a key mount of the rotation element upon insertion into the rotation element.

5. The locking device according to claim 1, wherein a locking bar is connected to the center axis, wherein the locking bar is rotatable by rotation of the rotation element between a locked position, in which the first connection carrier is inseparable from the second connection carrier, and an unlocked position, in which the first connection carrier and the second connection carrier are releasable from each other.

6. The locking device according to claim 5, wherein the locking bar lockingly engages a holding tongue of the second connection carrier, when in the locked position, and does not engage the locking tongue of the second connection carrier, when in the unlocked position.

7. The locking device according to claim 5, wherein the locking bar comprises two half bars.

8. The locking device according to claim 1, wherein the first connection carrier comprises a frame surrounding the rotation element.

9. The locking device according to claim 1, wherein the recesses extend centrally towards a center of the rotation element.

10. The locking device according to claim 1, wherein the key tongues and the corresponding recesses in the surface of the rotation element have forms that are complementary to each other.

11. A locking device with a first connection carrier and a second connection carrier, which are configured to be combined for establishing a detachable connection, wherein a rotation element is attached at the first connection carrier so as to be rotatable about a center axis;

a locking bar is connected to the center axis, wherein the locking bar is rotatable by rotation of the rotation element between a locked position, in which the first connection carrier is inseparable from the second connection carrier, and an unlocked position, in which the first connection carrier and the second connection carrier are releasable from each other;

the rotation element is provided in a circular inner region of the first connection carrier, the circular inner region being centered with respect to the center axis and having a radius being designated as a full radius;

a plurality of elastic blocking heads is attached at the first connection carrier along a circumference of the inner region, wherein the blocking heads are movable from a blocking position to a release position by mechanical pressure, wherein a blocking head does not protrude into the inner region when in the release position, and protrudes into the inner region when in the blocking position;

the rotation element comprises along its circumference segments which extend outwardly up to the full radius and segments which extend outwardly less than up to the full radius, wherein the segments extending outwardly up to the full radius move blocking heads bordering from outwards into the release position and segments extending outwardly less than up to the full radius leave blocking heads bordering from outwards in the blocking position, such that rotation of the rotation element is blocked by engagement of the blocking heads that are in the blocking position with a circumference of the rotation element; and the locking device comprises a flat key element having key tongues that are configured to be inserted into corresponding recesses in a surface of the rotation element, wherein the recesses are formed in those segments of the rotation element that extend outwardly less than up to the full radius, wherein the key tongues are, in the inserted state, configured to move the blocking heads bordering from outwards at the segments of the rotation element receiving the key tongues into the release position and to thereby allow rotation of the rotation element, and wherein opposing key tongues are symmetrically formed, so that the key element is insertable into the rotation element in two different orientations.

12. The locking device according to claim 11, wherein the key tongues extend outwardly up to the full radius in the inserted state.

13. The locking device according to claim 11, wherein the first connection carrier comprises a frame surrounding the rotation element.

14. The locking device according to claim 11, wherein the locking bar lockingly engages a holding tongue of the second connection carrier, when in the locked position, and does not engage the locking tongue of the second connection carrier, when in the unlocked position.

15. A locking device with a lock carrying connection carrier and a latching connection carrier, which are configured to be combined for establishing a detachable connection, wherein a rotation element is attached at the lock carrying connection carrier so as to be rotatable about a center axis;

a locking bar is connected to the center axis, wherein the locking bar is rotatable by rotation of the rotation element between a locked position, in which the locking bar lockingly engages a holding tongue of the latching connection carrier, and an unlocked position, in which the locking bar does not engage the locking tongue of the latching connection carrier;

the rotation element is provided in a circular inner region of the lock carrying connection carrier, the circular inner region being centered with respect to the center axis and having a radius being designated as a full radius;

a plurality of elastic blocking heads is attached at the lock carrying connection carrier along a circumference of the inner region, wherein the blocking heads are movable from a blocking position to a release position by mechanical pressure, wherein a blocking head protrudes into the inner region substantially up to a circular line centered with respect to the center axis and having a radius designated as an inner radius, which is smaller than the full radius, when in the blocking position, and does not protrude into the inner region when in the release position;

the rotation element comprises along its circumference segments which extend outwardly up to the full radius and segments which extend outwardly at a maximum up to the inner radius, wherein the segments extending outwardly up to the full radius move blocking heads bordering from outwards into the release position and segments extending outwardly at a maximum up to the inner radius leave blocking heads bordering from outwards in the blocking position, such that rotation of the rotation element is blocked by engagement of the blocking heads that are in the blocking position with a circumference of the rotation element; and the locking device comprises a flat key element having key tongues that are configured to be inserted into corresponding recesses in a surface of the rotation element, wherein the recesses are formed in those segments of the rotation element that extend outwardly at a maximum up to the inner radius, and wherein the key tongues are, in the inserted state, configured to move the blocking heads bordering from outwards at the segments of the rotation element receiving the key tongues into the release position and to thereby allow rotation of the rotation element, and wherein opposing key tongues are symmetrically formed, so that the key element is insertable into the rotation element in two different orientations.

16. The locking device according to claim 15, wherein the key tongues extend outwardly up to the full radius in the inserted state.

17. The locking device according to claim 15, wherein the lock carrying connection carrier comprises a frame surrounding the rotation element.

* * * * *